United States Patent [19]

Kopatz et al.

[11] Patent Number: 4,778,517

[45] Date of Patent: Oct. 18, 1988

[54] HYDROMETALLURGICAL PROCESS FOR PRODUCING FINELY DIVIDED COPPER AND COPPER ALLOY POWDERS

[75] Inventors: Nelson E. Kopatz, Sayre; Walter A. Johnson, Towanda, both of Pa.

[73] Assignee: GTE Products Corporation, Stamford, Conn.

[21] Appl. No.: 54,553

[22] Filed: May 27, 1987

[51] Int. Cl.[4] ..... B22F 9/00

[52] U.S. Cl. ..... 75/0.5 A; 75/0.5 BB; 75/0.5 C; 75/251; 264/10; 264/12; 264/15

[58] Field of Search ..... 75/0.5 A, 0.5 BB, 0.5 C, 75/251; 264/10, 12, 15

[56] References Cited

U.S. PATENT DOCUMENTS

| | | | |
|---|---|---|---|
| 2,735,757 | 2/1956 | Kapf | 75/0.5 |
| 3,652,259 | 3/1972 | Knopp | 75/0.5 B |
| 3,663,667 | 5/1972 | Cheney et al. | 264/14 |
| 3,909,241 | 9/1975 | Cheney et al. | 75/0.5 BB |
| 3,974,245 | 8/1976 | Cheney et al. | 75/0.5 BB |
| 4,042,374 | 8/1977 | Rasmussen et al. | 75/0.5 B |
| 4,348,224 | 9/1982 | Gingerich et al. | 75/0.5 A |
| 4,397,682 | 8/1983 | Watanabe et al. | 75/0.5 A |
| 4,533,382 | 8/1985 | Miura et al. | 75/0.5 C |
| 4,615,736 | 10/1986 | Armor et al. | 75/251 |
| 4,670,047 | 6/1987 | Kopatz et al. | 75/0.5 B |
| 4,687,511 | 8/1987 | Paliwal et al. | 75/0.5 B |

FOREIGN PATENT DOCUMENTS

| | | | |
|---|---|---|---|
| 0175824 | 4/1986 | European Pat. Off. | 75/0.5 A |
| 0150828 | 8/1986 | Japan | 75/0.5 A |
| 1174301 | 8/1986 | Japan | 75/0.5 A |
| 0224076 | 8/1977 | U.S.S.R. | 75/0.5 A |

*Primary Examiner*—Upendra Roy
*Attorney, Agent, or Firm*—Donald R. Castle

[57] ABSTRACT

A process for producing finely divided spherical copper copper alloy powders comprises forming an aqueous solution of copper and alternatively other metal values forming a reducible metallic material from the solution, reducing the material to metal powder particles, subjecting the metal particles to a high temperature zone to melt a portion of the metal powder particles and to form droplets and cooling the droplets to form an essential spherical metal alloy particles.

12 Claims, No Drawings

HYDROMETALLURGICAL PROCESS FOR PRODUCING FINELY DIVIDED COPPER AND COPPER ALLOY POWDERS

FIELD OF THE INVENTION

This invention relates to the preparation of fine copper powders. More particularly it relates to the production of such powders having substantially spherical particles.

BACKGROUND OF THE INVENTION

U.S. Pat. No. 3,663,667 discloses a process for producing multimetal alloy powders. Thus, multimetal alloy powders are produced by a process wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce said metallic compounds to temperatures below the melting point of any of the metals in said alloy.

U.S. Pat. No. 3,909,241 relates to free flowing powders which are produced by feeding agglomerates through a high temperature plasma reactor to cause at least partial melting of the particles and collecting the particles in a cooling chamber containing a protective gaseous atmosphere where the particles are solidified. In this patent the powders are used for plasma coating and the agglomerated raw materials are produced from slurries of metal powders and binders. Both the U.S. Pat. Nos. 3,663,667 and 3,909,241 are assigned to the same assignee as the present invention.

In European Patent Application No. W08402864 published Aug. 2, 1984, also assigned to the assignee of this invention, there is disclosed a process for making ultra-fine powder by directing a stream of molten droplets at a repellent surface whereby the droplets are broken up and repelled and thereafter solidified as described therein. While there is a tendency for spherical particles to be formed after rebounding, it is stated that the molten portion may form elliptical shaped or elongated particles with rounded ends.

Production of copper and copper based alloys powders have also been produced by gas and water atomization of molten ingots of copper or copper alloy. These methods generally produce a relatively large fraction of material above about 20 microns.

As used in this invention the term "copper based" materials or alloys or particles means the foregoing substances which includes copper per se and alloys of copper with one or more additional metals in which copper is the major metal, usually in amounts of greater than 50% by weight.

It is believed therefore that a relatively simple process which enables finely divided metal alloy powders to be hydrometallurgically produced from sources of the individual metals is an advancement in the art.

SUMMARY OF THE INVENTION

In accordance with one aspect of this invention there is provided a process comprising forming aqueous solution containing metal values of copper, removing sufficient water from the solution to form a reducible solidified copper compound selected from the group consisting of copper salts, copper oxides and mixtures thereof.

Thereafter the copper compound and other metallic compounds if present is reduced to form a copper based powder selected from the group consisting of copper powders and copper alloy powders. A portion of the copper based powder is entrained in a carrier gas and fed into a high temperature reaction zone to thereby melt at least a portion of the metal powder. The molten material is then solidified in the form of metal spheres which are either copper powder or copper alloy powders having an average particle size of less than about 20 microns.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

While it is preferred to use metal powders as starting materials in the practice of this invention because such materials dissolve more readily than other forms of metals, however, use of the powders is not essential. Metallic salts that are soluble in water or in an aqueous mineral acid can be used. When alloys are desired, the metallic ratio of the various metals in the subsequently formed solids of the salts, oxides or hydroxides can be calculated based upon the raw material input or the solid can be sampled and analyzed for the metal ratio in the case of alloys being produced. The metal values can be dissolved in any water soluble acid. The acids can include the mineral acids as well as the organic acids such as acetic, formic and the like. Hydrochloric is especially preferred because of cost and availability.

After the metal sources are dissolved in the aqueous acid solution, the resulting solution can be subjected to sufficient heat to evaporate water. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size, generally below about 20 micrometers by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a homogenous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers.

In preparing the powders of the present invention, a high velocity stream of at least partially molten metal droplets is formed. Such a stream may be formed by any thermal spraying technique such as combustion spraying and plasma spraying. Individual particles can be completely melted (which is the preferred process), however, in some instances surface melting sufficient to enable the subsequent formation of spherical particles from such partially melted particles is satisfactory. Typically, the velocity of the droplets is greater than about 100 meters per second, more typically greater than 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably considerably above the melting point of the highest melting component of the material to enable a relatively short residence time in the reaction zone.

The stream of dispersed entrained molten metal droplets may be produced by plasma-jet torch or gun apparatus of conventional nature. In general, a source of metal powder is connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc powder and the rate of gas flow, torch temperatures can range from 5500 degrees centigrade up to about 15,000 degrees centigrade. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas stream. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxyacetylene type having high pressure fuel gas flowing through the nozzle. The powder may be introduced into the gas by an aspirating effect. The fuel is ignited at the nozzle outlet to provide a high temperature flame.

Preferably the powders utilized for the torch should be uniform in size and composition. A relatively narrow size distribution is desirable because, under set flame conditions, the largest particles may not melt completely, and the smallest particles may be heated to the vaporization point. Incomplete melting is a detriment to the product uniformity, whereas vaporization and decomposition decreases process efficiency. Typically, the size ranges for plasma feed powders of this invention are such that 80 percent of the particles fall within about a 15 micrometer diameter range.

The stream of entrained molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decreases the velocity of the droplets. As the atmosphere approaches a vacuum, the cooling and velocity loss is diminished. It is desirable that the nozzle be positioned sufficiently distant from any surface so that the droplets remain in a droplet form during cooling and solidification. If the nozzle is too close, the droplets may solidify after impact.

The stream of molten particles may be directed into a cooling fluid. The cooling fluid is typically disposed in a chamber which has an inlet to replenish the cooling fluid which is volatilized and heated by the molten particles and plasma gases. The fluid may be provided in liquid form and volatilized to the gaseous state during the rapid solidification process. The outlet is preferably in the form of a pressure relief valve. The vented gas may be pumped to a collection tank and reliquified for reuse.

The choice of the particle cooling fluid depends on the desired results. If large cooling capacity is needed, it may be desirable to provide a cooling fluid having a high thermal capacity. An inert cooling fluid which is non-flammable and nonreactive may be desirable if contamination of the product is a problem. In other cases, a reactive atmosphere may be desirable to modify the powder. Argon and nitrogen are preferable nonreactive cooling fluids. Hydrogen may be preferable in certain cases to reduce oxides and protect from unwanted reactions. Liquid nitrogen may enhance nitride formation. If oxide formation is desired, air, under selective oxidizing conditions, is a suitable cooling fluid.

Since the melting plasmas are formed from many of the same gases, the melting system and cooling fluid may be selected to be compatible.

The cooling rate depends on the thermal conductivity of the cooling fluid and the molten particles to be cooled, the size of the stream to be cooled, the size of individual droplets, particle velocity and the temperature difference between the droplet and the cooling fluid. The cooling rate of the droplets is controlled by adjusting the above mentioned variables. The rate of cooling can be altered by adjusting the distance of the plasma from the liquid bath surface. The closer the nozzle to the surface of the bath, the more rapidly cooled the droplets.

Powder collection is conveniently accomplished by removing the collected powder from the bottom of the collection chamber. The cooling fluid may be evaporated or retained if desired to provide protection against oxidation or unwanted reactions.

The particle size of the spherical powders will be largely dependent upon the size of the feed into the high temperature reactor. Some densification occurs and the surface area is reduced thus the apparent particle size is reduced. The preferred form of particle size measurement is by micromergraphs, sedigraph or microtrac. A majority of the particles will be below about 20 micrometers or finer. The desired size will depend upon the use of the alloy. For example, in certain instances such as microcircuity applications extremely finely divided materials are desired such as less than about 3 micrometers.

The powdered materials of this invention are essentially spherical particles which are essentially free of elliptical shaped material and essentially free of elongated particles having rounded ends, is shown in European Patent Application No. W08402864.

Spherical particles have an advantage over non-spherical particles in injection molding and pressing and sintering operations. The lower surface area of spherical particles as opposed to non-spherical particles of comparable size, makes spherical particles easier to mix with binders and easier to dewax.

To further illustrate this invention, the following non-limiting example is presented. All parts, proportions and percentages are by weight unless otherwise indicated.

EXAMPLE

About 700 parts of copper, as copper oxide, and about 300 parts of nickel powder are dissolved in about 4000 parts of 10 N HCl using a glass lined agitated reactor.

Ammonium hydroxide is added to a pH of about 6.5–7.5. The copper and nickel are precipitated as an intimate mixture of hydroxides. This mixture is then evaporated to dryness. The mixture is then heated to about 350° C. in air for about 3 hours to remove the excess ammonium chloride. This mixture is then hammermilled to produce a powder having greater than 50% of the particles smaller than about 50 micrometers with no particles larger than about 100 micrometers. These milled particles are heated in a reducing atmosphere of $H_2$ at a temperature of about 700° C. for about 3 hours. Finely divided particles containing 70% copper and 30% nickel are formed.

The Cu-Ni powder particles are entrained in an argon carrier gas. The particles are fed to a Metco 9MB plasma gun at a rate of about 10 pounds per hour. The gas is fed at the rate of about 6 cubic feet per hour. The plasma gas ($Ar+H_2$) is fed at the rate of about 70 cubic feet per hour. The torch power is about 14 KW at about 35 volts and 400 amperes. The molten droplets exit into a chamber containing inert gas. The resulting powder contains two fractions, the major fraction consists of the spherical shaped resolidified particles. The minor fraction consists of particles having surfaces which have been partially melted and resolidified.

While there has been shown and described what are considered the preferred embodiments of the invention, it will be obvious to those skilled in the art that various changes and modifications may be made therein without departing from the scope of the invention as defined by the appended claims.

What is claimed:

1. A process of forming spherical shaped copper based metallic particles comprising:

(a) forming an aqueous solution containing copper as the major ingredient, (b) forming a first material having a major portion selected from the group consisting of reducible copper salts, copper oxide and copper hydroxide and mixtures thereof, (c) reducing said material to form a second material of copper based powder particles by heating said material in a reducing atmosphere at a temperataure above the reducing temperature of the salts but below the melting point of the metals in the particles, (d) entraining at least a portion of said second material in a carrier gas, (e) feeding said entrained material and said carrier gas into a high temperature zone and maintaining said second material in said zone for a sufficient time to melt at least about 50% by weight of said second material, and to form droplets therefrom and (f) cooling said droplets to form a third material of copper based metallic particles having essentially a spherical shape and a majority of said particles having a size less than 20 micrometers.

2. A process according to claim 1 wherein said aqueous solution is an acid solution from the group consisting of hydrochloric, sulfuric and nitric acids solutions.

3. A process according to claim 1 wherein said aqueous solution contains a water soluble acid.

4. A process according to claim 1 wherein said first material from step (b) is subjected to a particle size reduction step prior to the reduction step (c).

5. A process according to claim 1 wherein said high temperature zone is created by a plasma touch.

6. A process according to claim 1 wherein said carrier gas is an inert gas.

7. A process according to claim 1 wherein essentially all of said second material are melted.

8. A process according to claim 1 wherein said solution contains, in addition to copper, at least one additional metal at an alloy forming level and wherein a copper alloy powder particles are formed.

9. A process according to claim 1 wherein the powder particles from step (c) are subjected to a particle size reduction step prior to the entraining step (d).

10. A process according to claim 2 wherein said acid is hydrochloric acid.

11. A process according to claim 2 wherein said first material is formed by evaporation of the water from the solution.

12. A process according to claim 2 wherein said first material is formed by adjusting the pH of the solution to form a solid which is separated from the resulting aqueous phase.

* * * * *

UNITED STATES PATENT AND TRADEMARK OFFICE

CERTIFICATE OF CORRECTION

PATENT NO. : 4,778,517

DATED : October 18, 1988

INVENTOR(S) : Nelson E. Kopatz, Walter A. Johnson, Joseph E. Ritsko

It is certified that error appears in the above-identified patent and that said Letters Patent are hereby corrected as shown below:

On the title page:

Third inventor's name should be added - Joseph E. Ritsko -

Signed and Sealed this

Twenty-eighth Day of February, 1989

*Attest:*

DONALD J. QUIGG

*Attesting Officer*

*Commissioner of Patents and Trademarks*